US009844795B2

(12) United States Patent
Hoard et al.

(10) Patent No.: US 9,844,795 B2
(45) Date of Patent: Dec. 19, 2017

(54) ADHESIVE APPLICATOR

(71) Applicants: Leonard Brett Hoard, Winnipeg (CA); Aaron Matthew Hoard, Winnipeg (CA)

(72) Inventors: Leonard Brett Hoard, Winnipeg (CA); Aaron Matthew Hoard, Winnipeg (CA)

( * ) Notice: Subject to any disclaimer, the term of this patent is extended or adjusted under 35 U.S.C. 154(b) by 404 days.

(21) Appl. No.: 14/800,010

(22) Filed: Jul. 15, 2015

(65) Prior Publication Data

US 2017/0014854 A1 Jan. 19, 2017

(51) Int. Cl.

| | |
|---|---|
| ***B05C 13/02*** | (2006.01) |
| ***B05C 5/02*** | (2006.01) |
| ***B05C 11/10*** | (2006.01) |
| *B05C 9/04* | (2006.01) |

(52) U.S. Cl.

CPC ..... *B05C 5/0216* (2013.01); *B05C 5/0241* (2013.01); *B05C 11/1021* (2013.01); *B05C 13/02* (2013.01); *B05C 5/0204* (2013.01); *B05C 9/04* (2013.01)

(58) Field of Classification Search

CPC ..... B05C 5/0241; B05C 13/00–13/02
USPC ..... 118/304, 319, 500, 503; 156/345.55
See application file for complete search history.

(56) References Cited

U.S. PATENT DOCUMENTS

| | | | | |
|---|---|---|---|---|
| 3,968,020 A * | 7/1976 | Nagano | B05C 3/02 | 118/425 |
| 5,643,362 A * | 7/1997 | Garves | B05B 13/0228 | 118/264 |
| 6,709,514 B1 * | 3/2004 | Hossainy | B05B 3/001 | 118/319 |
| 8,042,486 B2 * | 10/2011 | Pacetti | B05D 1/005 | 118/320 |

* cited by examiner

*Primary Examiner* — Dah-Wei D. Yuan
*Assistant Examiner* — Stephen A Kitt
(74) *Attorney, Agent, or Firm* — Adrian D. Battison; Ade & Company Inc.

(57) ABSTRACT

An apparatus for applying adhesive to both ends of each of a pair of rails for adhesive attachment to posts for example of a door includes a support head with two channels and center fence for supporting the rails in parallel position for presenting the ends side by side vertically upwardly to an adhesive applicator head with a nozzle guided by a three axis movable support. The support head is rotatable through 180 degrees about a transverse axis so as to present the other ends and there is provided a drive system defined by set of drive rollers for driving the rails up to an end stop position at which the presented ends are at the adhesive applicator head. A laser sensor detects the end profile to ensure that the adhesive pattern matches a preselected required layout and to ensure no contact between the nozzle and the profile.

17 Claims, 4 Drawing Sheets

40
24
15A
15
21
13,14
13
20
16
17
24
24B
15B
24A 22
19
11
14
15
26
12
22A
22B
18
25
13
26
25A
25
27
23B
23
23A

ADHESIVE APPLICATOR

This invention relates to an apparatus for applying adhesive to the ends of a pair of elongate members for example for use in assembly of doors, panels and the like where two rails are attached to two uprights by adhesive applied at the ends of one or more of the parts.

BACKGROUND OF THE INVENTION

One action that is required in the assembly of rails and posts of doors is that of applying adhesive to the end of the rails or copes so that they can be assembled onto position with the posts to form the door structure which may be covered with a covering sheet or may be filled with a panel.

Up to now this application of the adhesive has been carried out manually leaving it to the variation that different operators can bring. Also the adhesive is typically applied by brush so that the pattern applied is simple and not optimised to obtain the best adhesive effect.

SUMMARY OF THE INVENTION

It is one object of the present invention to provide an automated system to apply adhesive to the ends of elongate members.

According to the invention there is provided an apparatus for applying adhesive to both of the first and second ends of each of a pair of elongate members comprising:

- a support head for receiving and supporting the pair of elongate members;
- the support head including first and second receptacles each for receiving a respective one of the elongate members;
- the receptacles comprising a pair of side by side channels arranged such that with the elongate members in the respective channels the elongate members are supported in parallel position with the ends presented at one end of the support head;
- an adhesive applicator head for applying adhesive to the presented ends comprising:
  - a nozzle for dispensing adhesive;
  - a mounting assembly for mounting the nozzle facing the presented ends and for moving the nozzle in a direction toward and away from the ends and in at least one direction along the ends;
- the support head being rotatable through 180 degrees about an axis generally transverse to the channels so as to move the channels from a first position in which the first ends of both of the elongate members are presented to the adhesive applicator head and a second position in which the second ends of both of the elongate members are presented to the adhesive applicator head;
- and a drive system for driving the elongate members longitudinally of the channels so as to move the ends thereof up to an end stop position at which the presented ends are at the adhesive applicator head.

Preferably there is provided a separator fence between the pair of elongate members so that they are held spaced during the movements and during the application. However they can be side by side. Or they can be held by drive members on both sides.

Preferably the separator fence includes slide surfaces, such as UHMW polyethylene, engaging side surfaces of the elongate members over which the elongate members move as they are driven longitudinally.

Preferably the drive system comprises a first and a second set of drive rollers each set arranged to engage a respective one of the elongate members. However the members may be driven by belts or other supports.

Preferably the drive rollers are movable to a position spaced from the respective elongate member to allow insertion into and removal from the respective channel of the elongate member. Where the drive members cooperate with a center fence, this requires the drive members or rollers to pivot away from the fence to allow the width of the channel into which they are to be inserted to be temporarily increased.

Preferably each channel also includes a releasable holding system for holding the elongate member in the channel when the drive system is released. The holding system is arranged to create sufficient friction to hold the part in place before the camping system takes over when the holding system is released. Preferably the holding system locates the rails against movement longitudinally of the channel so that the worker can place the rails into the channels so that they are held against falling downwardly whereupon the clamping system can close when the worker's hands are removed. The holding system can comprise flexible fingers, a spring loaded bar or other simple holding elements. The operation can be effected by an air cylinder or other suitable system.

Preferably the adhesive applicator head is above the support head for directing the adhesive downwardly on the ends as this uses gravity to carry the adhesive accurately and prevents runback onto the nozzle or supports.

Preferably therefore the channels are vertical and the support head rotates about a horizontal axis so that in both positions the adhesive is delivered downwardly.

Preferably there is a single adhesive applicator head which is arranged to apply adhesive to the first end of one elongate member and subsequently to the first end of the other elongate member. And subsequently to the second ends of both members. However more than one adhesive applicator could be provided.

Preferably there is provided a laser sensor, which can be on the applicator head, for detecting an end profile of an end of one of the elongate members which is used in order to identify the elongate member and to select from a plurality of stored adhesive patterns that required for the detected profile and which is used in order to identify the elongate member and to ensure that the nozzle is moved relative to the profile including in the direction toward and away from the profile without contacting the profile.

Preferably the drive system is arranged to accommodate elongate members of different lengths so that the elongate members are driven by different distances up to the end stop position depending on their length. In this way the same system can be programed to apply adhesive to parts for many different size of doors.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figures 1, 2:
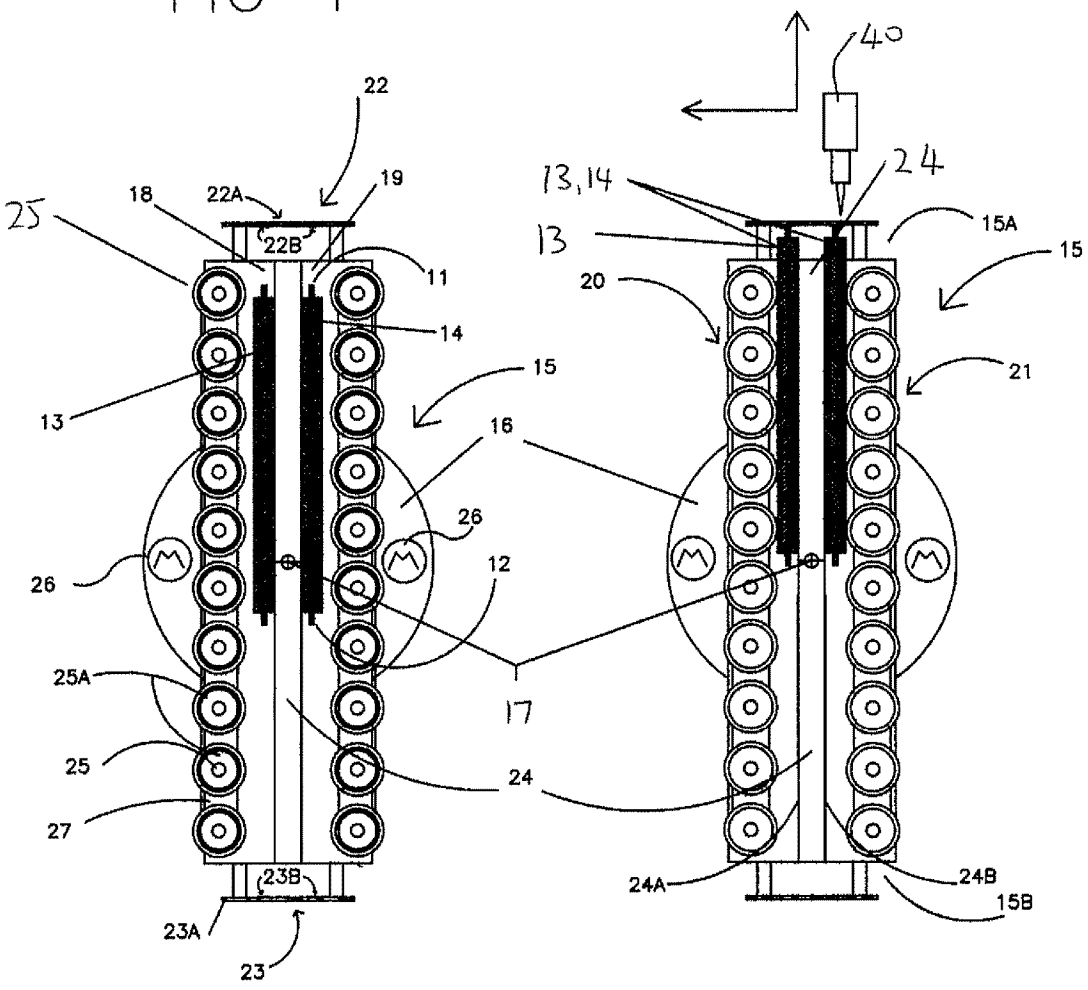
FIG. 1 is a front elevational view of an apparatus according to the present invention showing the apparatus in a first position in which the elongate members to be glued are first manually inserted into the apparatus.
FIG. 2 is a front elevational view of the apparatus of FIG. 1 showing the apparatus in a second position in which the elongate members to be glued are moved up to the adhesive applicator head.

The apparatus 10 for applying adhesive to both of the first and second ends 11, 12 of each of a pair of elongate members or rails 13, 14 is shown in the drawings and includes a vertical support head 15 mounted on a turntable 16 for rotation about a horizontal shaft 17.

The support head 15 has two channels 18, 19 defining receptacles each for receiving and supporting a respective one of the pair of rails to be glued.

The receptacles 18, 19 are arranged side by side such that with the rails 13, 14 in the respective channels 18, 19 the rails are supported in parallel position with the ends 11 presented at one end 15A of the support head 15 and the opposite ends 12 oriented to be presented at a second end 15B of the head 15.

Figure 4:
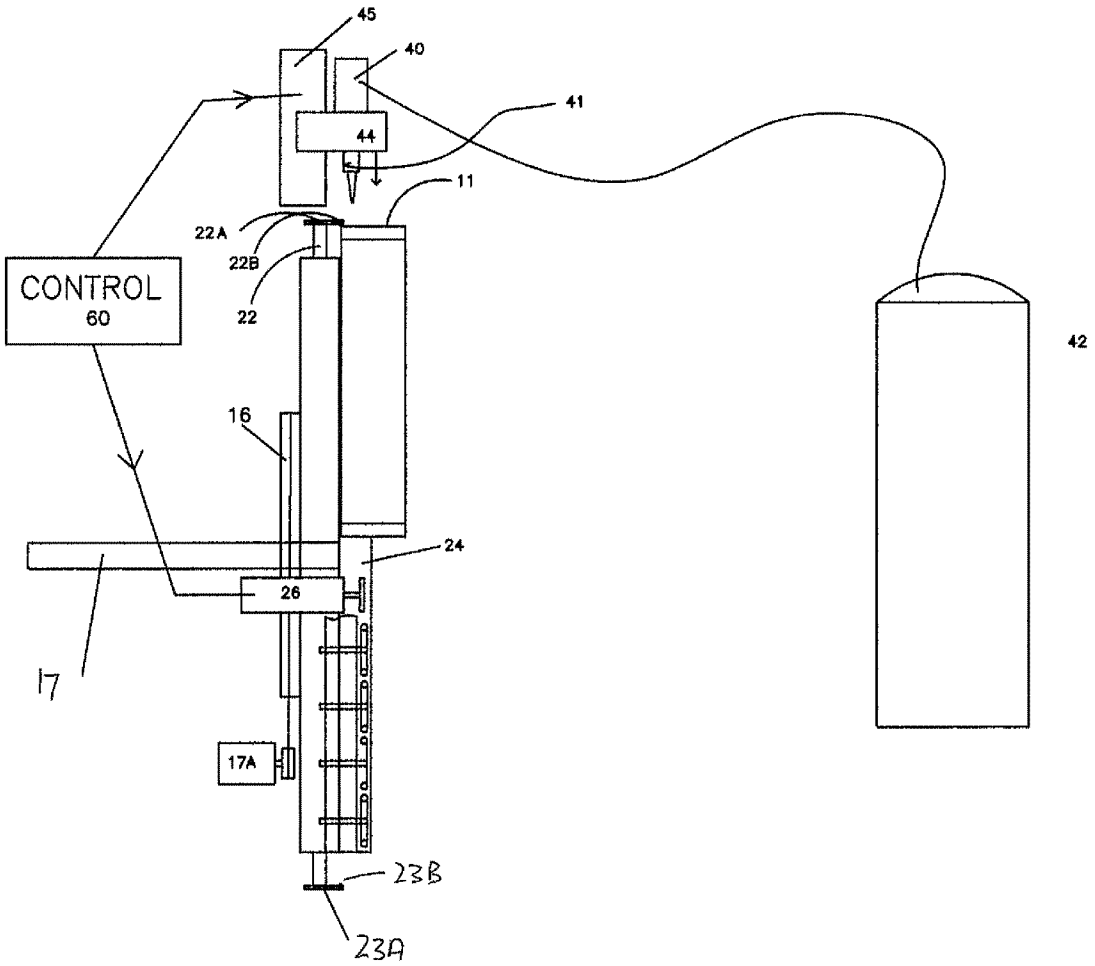
FIG. 4 is a side elevational view of the apparatus of FIG. 1.
Figure 5:
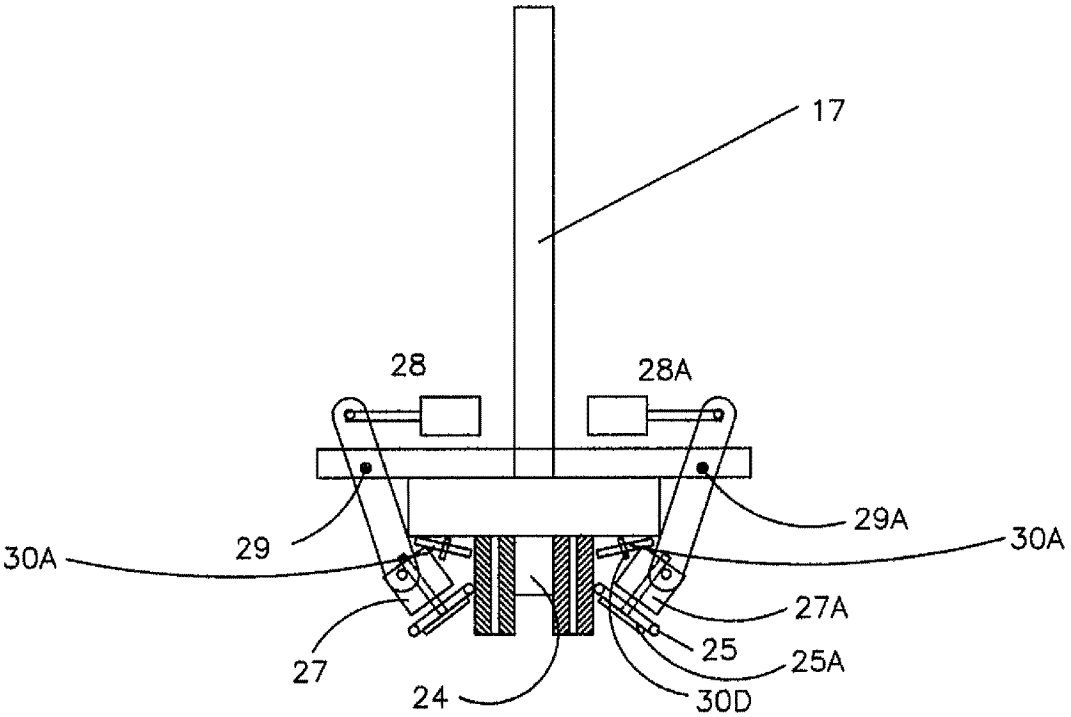
FIG. 5 is a top plan view of the apparatus of FIG. 1.

The support head is rotatable through 180 degrees about the axis of the shaft 17 which is generally transverse to the channels driven by a motor 17A shown schematically in FIG. 4 so as to move the channels from a first position in which the first ends 11 of both of the rails 13, 14 are presented vertically upwardly and a second position in which the second ends 12 of both of the rails 13, 14 are presented vertically upwardly.

The support head 15 also includes a drive system 20, 21 for each channel 18, 19 arranged for driving the rails 13, 14 longitudinally of the channels so as to move the ends 11 thereof up to an end stop position 22. The end stop position 22 includes a physical end stop bar 22A and a microswitch 22B which detects the presence of the end 11. Symmetrical a second end stop member 23 including a bar 23A and a sensor 23B is located at the end 15B of the support head.

The two channels 18, 19 are separated in the center by a separator fence in the form of a bar located between the pair of rails so as to engage the inside side surfaces of the rails so that the rails are held in the channels by the drive system on the outside and by the fence on the inside against any side to side movement.

The separator fence 24 includes slide surfaces 24A and 24B engaging side surfaces of the rails 13, 14 over which the rails 13, 14 move as they are driven longitudinally. The drive systems 20, 21 each include a set of drive rollers 25 of the type including a grooved wheel with a flexible peripheral tire arranged to engage a side of the adjacent rail 13, 14. The wheels are mounted on a support bar 27, 27A and are driven by a motor 26 which drives a row of spur gears 25A attached to the wheels with intervening idlers so that they all rotate in the same direction to engage and forward the side surface of the rail which slides against the fence.

The whole of the drive system including the bar 27, 27A and the drive rollers carried thereby are movable to a position spaced from the respective elongate member to allow insertion into and removal from the respective channel of the elongate member. This movement is obtained by an actuator schematically indicated at 28, 28A which acts to pivot the bar 27 about a pivot axis 29, 29A.

In addition to the clamping system defined by the rollers and the center fence, each channel includes a releasable holding system for holding the elongate member in the channel when the drive system provided by the rollers 25 is released. This holding system comprises two longitudinally spaced pairs of fingers 30A at spaced positions along the channel for cooperation with the fence to hold the rail in place by engaging a side surface of the elongate member. The fingers are operated by a bar 30D which can pivot when activated to release the fingers from the side of the rail and allow the rail to be moved by the drive rollers along the channel. That is the fingers hold the rails against falling when inserted by the user so that they hold the rails against downward movement but allow the worker to insert and remove the rails when the fingers are engaged. The fingers are released when the rollers take over to move the rails to the required locations.

The rails are presented when at the stop 22 as detected by a microswitch 22B to an adhesive applicator head 40 for applying adhesive to the presented ends. The head 40 includes a nozzle 41 for dispensing adhesive from a remote supply 42 by a pressure in the supply so as to apply dabs or beads of adhesive as required.

The nozzle is mounted on a mounting assembly 45 facing the presented ends and for moving the nozzle in x, y and z planes so as to be movable a direction toward and away from the ends in the z direction and in at least one direction generally two directions in the x/y plane along the ends. The head is above the support head for directing the adhesive downwardly on the ends so that the channels are vertical and the support head rotates about a horizontal axis. As shown in FIG. 4, the end stop 22 is a bar 22A which just engages the rear end of the upwardly presented edge 11 so as to leave exposed the remainder of the edge 11 to receive the selected pattern of the adhesive.

A control processor 60 is provided which controls the head 40 and the motors 17A and 26. The control 60 controls the head 40 so as to apply adhesive to the first end 11 of rail and subsequently to the first end 11 of the other rail.

In addition the head 40 carries a laser sensor 44 for detecting an end profile of the end 11 of one of the rails where the laser sensor 44 detects the profile of the first end of one elongate member in advance of the application of adhesive in order to identify the elongate member and to select from a plurality of stored adhesive patterns that are required for the detected profile. Also the laser sensor detects the profile of the first end of one elongate member in order to identify the elongate member and to ensure that the nozzle is moved relative to the profile including in the direction toward and away from the profile without contacting the profile.

Figure 3:
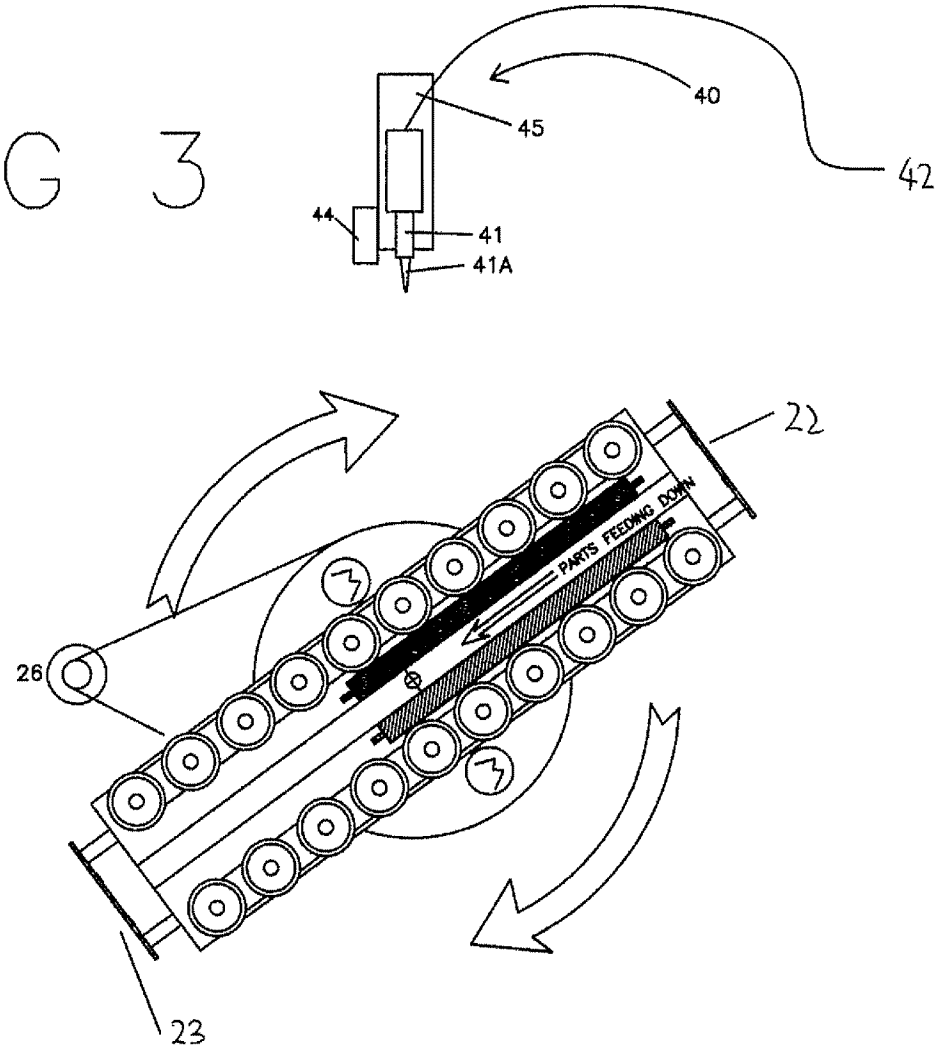
FIG. 3 is a front elevational view of the apparatus of FIG. 1 showing the apparatus in a third position in which the support head is rotated to bring the second ends up to the applicator head.

As shown in FIG. 3, the drive system is arranged to accommodate rails of different lengths so that the rails are driven by different distances up to the end stop position 22 depending on their length. Thus the worker can initially locate the rails in the channels at any position along the length of the channel within the grasp of the fingers 30A and the first action of the system is to release the fingers and engage the wheels so as to drive the rails to the end stop 22. In this way the rails are always in a repeatable attained position when the adhesive is applied. A further position sensor (not shown) can be provided for detecting when the end of the profile is reaching the end stop position so that the movement is slowed from a high speed to a low speed to engage the end stop bar 22A.

The laser sensor 44 then is moved by the drive 45 to scan the end profile to determine its unique pattern following which the required movement of the nozzle is obtained from a series of patterns stored in the control 60 and that movement is applied sequentially to the ends 11 and then by rotating the support head 15 to the ends 12 following which the clamping system is released, the finger engaged by an actuator 30D to hold the rails temporarily and the operator can remove the rails by pulling the rail out of the fingers 30A.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. Apparatus for applying adhesive to both of the first and second ends of each of a pair of elongate members comprising:

a support head for receiving and supporting the pair of elongate members;

the support head including first and second receptacles each for receiving a respective one of the elongate members;

the receptacles comprising a pair of side by side channels arranged such that with the elongate members in the respective channels the elongate members are supported in parallel position with the ends presented at one end of the support head;

an adhesive applicator head for applying adhesive to the presented ends comprising:

a nozzle for dispensing adhesive;

a mounting assembly for mounting the nozzle facing the presented ends and for moving the nozzle in a direction toward and away from the ends and in at least one direction along the ends;

the support head being rotatable through 180 degrees about an axis generally transverse to the channels so as to move the channels from a first position in which the first ends of both of the elongate members are presented to the adhesive applicator head and a second position in which the second ends of both of the elongate members are presented to the adhesive applicator head;

and a drive system configured to drive the elongate members longitudinally of the channels so as to move the ends thereof up to an end stop position at which the presented ends are at the adhesive applicator head.

2. The apparatus according to claim 1 wherein there is provided a separator fence between the pair of elongate members.

3. The apparatus according to claim 2 wherein the separator fence includes slide surfaces engaging side surfaces of the elongate members over which the elongate members move as they are driven longitudinally.

4. The apparatus according to claim 1 wherein the drive system comprises a first and a second set of drive rollers each set arranged to engage a respective one of the elongate members.

5. The apparatus according to claim 4 wherein the first and second set of drive rollers are movable to a position spaced from the respective elongate member to allow insertion into and removal from the respective channel of the elongate member.

6. The apparatus according to claim 5 wherein each channel includes a releasable holding system for holding the elongate member in the channel when the drive system is released.

7. The apparatus according to claim 6 wherein the holding system comprises a plurality of longitudinally spaced fingers for engaging a side surface of the elongate member.

8. The apparatus according to claim 1 wherein the adhesive applicator head is above the support head for directing the adhesive downwardly on the ends.

9. The apparatus according to claim 1 wherein the channels are vertical and the support head rotates about a horizontal axis.

10. The apparatus according to claim 1 wherein the adhesive applicator head is arranged to apply adhesive to the first end of one elongate member and subsequently to the first end of the other elongate member.

11. The apparatus according to claim 1 wherein there is provided a laser sensor for detecting an end profile of an end of one of the elongate members.

12. The apparatus according to claim 11 wherein the laser sensor is arranged at or on the adhesive applicator head.

13. The apparatus according to claim 11 wherein the laser sensor detects the profile of the first end of one elongate member in order to identify the elongate member and to select from a plurality of stored adhesive patterns that required for the detected profile.

14. The apparatus according to claim 11 wherein the laser sensor detects the profile of the first end of one elongate member in order to identify the elongate member and to ensure that the nozzle is moved relative to the profile including in the direction toward and away from the profile without contacting the profile.

15. The apparatus according to claim 1 wherein the drive system is arranged to accommodate elongate members of different lengths so that the elongate members are driven by different distances up to the end stop position depending on their length.

16. The apparatus according to claim 15 wherein there is provided a detector for detecting when the end of the profile is adjacent the end stop position.

17. The apparatus according to claim 1 wherein the end stop positions include physical end stop members for engaging an end of each of the elongate members without interfering with the application of the adhesive thereto.

* * * * *